US010266231B2

(12) United States Patent
Van De Steene et al.

(10) Patent No.: US 10,266,231 B2
(45) Date of Patent: Apr. 23, 2019

(54) FOLDABLE WATERCRAFT

(71) Applicant: ONAK BVBA, Ghent (BE)

(72) Inventors: Otto Van De Steene, Ghent (BE); Thomas Weyn, Ghent (BE); Timothy Galle, Melle (BE)

(73) Assignee: ONAK BVBA, Ghent (Zwijnaarde) (BE)

( * ) Notice: Subject to any disclaimer, the term of this patent is extended or adjusted under 35 U.S.C. 154(b) by 0 days.

(21) Appl. No.: 15/764,478

(22) PCT Filed: Oct. 2, 2016

(86) PCT No.: PCT/EP2016/073530
§ 371 (c)(1),
(2) Date: Mar. 29, 2018

(87) PCT Pub. No.: WO2017/055621
PCT Pub. Date: Apr. 6, 2017

(65) Prior Publication Data

US 2018/0273143 A1 Sep. 27, 2018

(30) Foreign Application Priority Data

Oct. 1, 2015 (BE) ..... 2015/5606

(51) Int. Cl.
*B63B 35/71* (2006.01)
*B63B 7/02* (2006.01)
(Continued)

(52) U.S. Cl.
CPC ..... *B63B 7/02* (2013.01); *B63B 7/06* (2013.01); *B63B 35/71* (2013.01); *B63B 2007/003* (2013.01); *B63C 13/00* (2013.01)

(58) Field of Classification Search
CPC ..... B63B 7/02; B63B 35/71; B63B 2007/003
See application file for complete search history.

(56) References Cited

U.S. PATENT DOCUMENTS 2,880,429 A * 4/1959 Henry ..... B63B 7/06 114/353
2,969,551 A * 1/1961 Snider ..... B63B 9/062 114/355
3,771,180 A * 11/1973 Tanabe ..... B63B 7/00 114/354
(Continued)

FOREIGN PATENT DOCUMENTS

DE 202013008654 U1 11/2013
FR 1605028 A 8/1972
(Continued)

OTHER PUBLICATIONS

Belgian Search Report from BE Application No. BE 201505606, dated Jun. 3, 2016.
(Continued)

*Primary Examiner* — S. Joseph Morano
*Assistant Examiner* — Jovon E Hayes
(74) *Attorney, Agent, or Firm* — Workman Nydegger

(57) ABSTRACT

A watertight foldable system comprises a watertight panel in which folds have been made such that the panel may be folded from a flat state into an open-top watercraft such as for example a canoe. The panel comprises a set of folds such that the watercraft, after it has been folded into watercraft, has a bottom having a flat profile in longitudinal direction or having a convex profile relative to the watercraft.

19 Claims, 16 Drawing Sheets

(51) Int. Cl.

| | |
|---|---|
| ***B63B 7/06*** | (2006.01) |
| *B63B 7/00* | (2006.01) |
| *B63C 13/00* | (2006.01) |

(56) References Cited

U.S. PATENT DOCUMENTS

| | | | | |
|---|---|---|---|---|
| 6,615,762 | B1 * | 9/2003 | Scott | B63B 7/04 114/353 |
| 9,527,626 | B1 * | 12/2016 | Coronado | A45C 7/0036 |
| 9,815,523 | B2 | 11/2017 | Jin et al. | |
| 2008/0041295 | A1 * | 2/2008 | Espeseth | B63B 7/02 114/347 |
| 2009/0044743 | A1 * | 2/2009 | Wagenknecht | B63B 7/02 114/354 |
| 2010/0058971 | A1 * | 3/2010 | Rixford | B63B 7/04 114/352 |
| 2011/0017121 | A1 * | 1/2011 | Willis | B63B 35/71 114/347 |
| 2013/0233234 | A1 * | 9/2013 | Crumpton | B63B 35/71 114/347 |
| 2016/0257378 | A1 * | 9/2016 | Jin | B63B 7/06 |

FOREIGN PATENT DOCUMENTS

| | | | |
|---|---|---|---|
| JP | S5174996 | U | 6/1976 |
| JP | S5174997 | U | 6/1976 |
| NL | 1030902 | C1 | 7/2007 |
| WO | 2015080423 | A1 | 6/2015 |

OTHER PUBLICATIONS

International Search Report from PCT Application No. PCT/EP2016/073530, dated Feb. 3, 2017.

* cited by examiner

FOLDABLE WATERCRAFT

FIELD OF THE INVENTION

This invention generally relates to foldable watertight structures. More specifically, the invention relates to a foldable watercraft of the open type such as for example a canoe or a fishing boat. As the structure is foldable, it can be transported more easily.

BACKGROUND OF THE INVENTION

Boats, due to their weight and shape, are generally not suitable for being transported in for example a car or for example for being carried during hiking tours.

For this, boats are developed that may be made compact for during transport and which may be assembled using the least possible extra tools and in a time as quick as possible.

A type of boats that are compact during transport are inflatable boats. A disadvantage of this type of boats is however that inflating may take a long time and furthermore, they are sensitive to wear and tear or rupture as sharp objects in the waterways to be navigated may give rise to leaking of the air compartments.

Another type of boats that may be made compact is illustrated in US2008/0041295. This boat consists of a watertight skin and a plurality of ribs that form the structure around which the skin may be tensioned. However, preparing for navigating may take a long time.

In U.S. Pat. No. 6,615,762, a boat is described in which the need for a skeleton structure is prevented. The boat is assembled from extruded corrugated plastic plates whereby they may be folded into a boat shape. The boat is made watertight by providing a watertight cover which is folded around the plates.

However, there is room for a more efficient system that is foldable into a boat and for a more efficient method for making such a system.

SUMMARY OF THE INVENTION

An object of embodiments of the present invention is to provide a good foldable watertight open-top watercraft, such as for example canoes or fishing boats.

The preceding aim is achieved by an appliance, device and/or method according to the present invention.

The present invention relates to a watertight foldable system, the system comprising a watertight panel in which folds have been made such that the panel may be folded from a flat state into an open-top watercraft, the panel comprising a set of folds such that the watercraft, after it has been folded into watercraft, has a bottom having a flat profile in longitudinal direction or having a convex profile relative to the watercraft. The open-top watercraft may for example be a canoe or a fishing boat. The stability of folded open watercraft is a greater challenge than for example for closed watercraft. In embodiments of the present invention, the bottom therefore has a profile in the longitudinal direction such that the bottom of the watercraft, when lying on the water in normal orientation, bulges out towards the water. It is an advantage of embodiments of the present invention that the watercraft has a better manoeuvrability and may reach a higher speed than a watercraft with a concave longitudinal profile for its bottom.

The set of folds comprises at least two subsets of folds, in which each of the subsets of folds consists of a first and a second fold which are substantially in the longitudinal direction of the boat, the first and the second folds not being in parallel but make contact with one another at a sharp angle, and which may be pleated such that the side wall of the watercraft, after it has been folded, is locally formed by three overlapping layers of the watertight panel.

It is an advantage of embodiments of the present invention that locally having three overlapping layers of the watertight panel results in an increased sturdiness of the watercraft. The first and the second folds together show a zigzag pattern such that at least three layers of the panel end up lying on top of one another.

The first and the second fold may start from the edge of the panel, when it is in folded-open state and whereby the contact point of the two folds is more centrally located within the panel.

In embodiments of the present invention, the starting points of the first and the second folds at the edge of the panel are located closer to the corner point of the panel than to the contact point of the two folds.

The minimum of two subsets of folds may be exactly four subsets of folds. The first fold may be formed by two adjoining pleat lines.

It is an advantage of embodiments of the present invention that by the use of two adjoining pleat lines, the folds may be carried out more easily.

The watercraft may be a canoe.

The use of an additional loose bottom plate may be prevented and the bottom may be formed fully by the folded panel.

It is an advantage of embodiments of the present invention that a sturdy construction may be achieved without a separate bottom plate needing to be provided.

At least one nose of the watercraft may be formed by one or several folds 1560 such that the nose is locally formed by at least four overlapping layers of the watertight panel 110. The number of overlapping layers may for example be at least 8 or even at least 10.

At least one nose of the watercraft may be formed by at least 7 folds. It is an advantage of embodiments of the present invention that a sturdy and stable construction is achieved.

Embodiments of the present invention furthermore have a high stability on the water, both in terms of primary and secondary stability.

It is an advantage of embodiments of the present invention that a watertight construction is achieved which may be made ready to use more efficiently. It is an advantage of embodiments of the present invention that no further separate waterproofing needs to be put in place.

It is an advantage of embodiments of the present invention that a watercraft may be folded from a flat panel. By folding a part of the flat panel inwards, a nose (bow and possibly stern) may be formed.

At least one of the noses may be formed from an end of the panel consisting of contiguous sections. It is an advantage of embodiments of the present invention that no additional seals are required, as the nose is made up of a panel the sections of which are fully contiguous. Due to the inner and outer folds at the bow and possibly the stern, a hull shape may be formed without parts of the panel at the edges needing to be attached together by means of a watertight connection. It may however possibly be that pieces of material are removed from the panel at the level of the non-floating part of the watercraft. However, this is not essential and does not affect the watertightness.

The folding pattern may be adapted to provide a section of the panel near the nose which, when the system has been folded into watercraft, is substantially oriented in the latitudinal direction of the watercraft.

The panel may comprise several folds in the latitudinal direction such that the panel may be folded up into a transport shape for transporting the foldable watercraft, the length of the transport shape of which corresponding with the width of the folded-out panel.

It is an advantage of embodiments of the present invention that when folded up, the panel may be extraordinarily compact in width, for example not wider than the width of a person, such that the boat may be easily transported. In embodiments of the present invention, the panel may be folded such that it may be carried on one's back and/or may be transported in a car and/or may be transported by bicycle. The folds for folding up may be positioned in function of the transport means with which the panel is to be transported.

The folds may be made in the transverse direction such that when the panel is folded up, hollow spaces are present inside the folded-up panel.

It is an advantage of embodiments of the current invention that associated material, such as for example tensioning straps and/or paddles, may be stored in the hollow spaces when the panel is folded up.

The folds in the transverse direction may be made such that the panel may be folded up in a single or double spiral shape. It is an advantage of embodiments of the present invention that a compact shape of the panel may be achieved. The spiral shape may also be a double spiral shape whereby the panel is rolled up to the middle along both sides. In both cases the folds may be positioned such that there are hollow spaces inside the folded-up panel. It is an advantage of embodiments of the present invention that material may be stored in here.

The system may comprise tensioning straps which may be tensioned in a cross from one side of the watercraft to the other side of the watercraft. It is an advantage of embodiments of the present invention that the boat structure is reinforced and that the rigidity of the boat is increased by adding tensioning straps. By fitting these tensioning straps, the relative movement for example of the front relative to the rear may be decreased during navigation. This improves the stability of the boat and also the navigation characteristics of the boat. By increasing the rigidity of the boat, less energy will be lost in the deformation of the boat during navigating (e.g. rowing). It is an advantage of embodiments of the present invention that the crossover of two tensioning straps may also serve to lean against. For this, a seat may even be fitted at the level of the crossover of two tensioning straps. It is an advantage of embodiments of the present invention that these seats may be moved across the tensioning straps or by tensioning or releasing the tensioning straps. In the latter case, the tension on the tensioning straps is achieved by sitting on the tensioning straps.

The system may comprise a spacer which may be positioned from the one side to the other side of the watercraft. It is an advantage of embodiments of the present invention that the distance between both sides of the watercraft may be fixed by a spacer. This increases the sturdiness of the boat. This spacer may for example be a rod.

The system may comprise at least two edges that are slidable across, which may be positioned over the sides of the watercraft.

It is an advantage of embodiments of the present invention that the edge of the watercraft is reinforced by the edges that may be slid across. In embodiments of the present invention, the edges that are slidable across have been formed such that they prevent the ingress of water and/or dirt into the watercraft over the sides. In embodiments of the present invention, the edges that are slidable across protect the watercraft against any impact. In embodiments of the present invention, these edges that are slidable across ensure that the force of the tensioning straps is shared across the sides of the watercraft. This prevents that local damage occurs at the level of the connection point of the tensioning straps. It is an advantage of embodiments of the present invention that the formation of pleats as a result of folding, which are required to fold the watercraft such that it may be transported in compact shape, is reduced by fitting edges that are slidable across at the edges of the watercraft. This pleat formation as a result of transverse folds is also reduced by the presence of folds in the longitudinal direction.

The edges that are slidable across may consist of a first profile with a U-shaped cross-section and a second profile that may be slid into the first profile and that is further adapted to screen any sharp extremities of the U-shaped cross-section of the first profile off from the watercraft.

It is an advantage of embodiments of the present invention that damage to the watercraft may be prevented by the action of sliding across the edges of the edges of the watercraft. It is an advantage of the use of an edge from several profiles that a better tension of the edge on the watercraft may be achieved.

The edge that is slidable across may comprise several shorter part elements which may be slid into one another.

It is an advantage of embodiments that the edge that are slidable across may be taken apart to be stored.

The system may comprise at least one rafter that may be placed transversally in the watercraft, contiguously with its inside.

It is an advantage of embodiments of the present invention that the hull may be made to hold its shape more by fitting one or more rafters.

The system may comprise a shielding that closely meets the folded-up panel for shielding the folded-up panel, folded up into its transport shape. It is an advantage of embodiments of the present invention that the folded-up panel is shielded during its transport. It is an advantage thereby that the shape of the folded-up panel allows the folded-up panel to be transported efficiently without its shape needing to be adapted. A closely connected shielding with the folded-up panel suffices.

Castors may be mounted onto the shielding, for transporting the folded-up panel by rolling it, folded up into its transport shape. It is an advantage of embodiments of the present invention that after fitting the shielding, the folded-up panel may be moved by rolling (for example as a trolley or as a trailer behind a bicycle).

The watertight panel may consist of a minimum of two layers, a first flexible watertight layer and a second non-flexible layer, whereby the first and the second layers have been permanently attached to one another such that they form one unit, the panel comprising folds whereby the folds have been made into the second layer such that the panel may be folded into a pre-intended shape.

The fold may consist of at least one cut in the second layer, while no cut or pleat line has been made into the first flexible watertight layer.

The fold may consist of a pleat line in the second layer, while no cut or pleat line has been made into the first flexible watertight layer, and the diameter of the pleat line in the second layer may be a corner.

The fold may consist of two adjoining pleat lines and whereby the distance between the two pleat lines is smaller than the width of a pleat line.

The second layer may comprise a material having a honeycomb structure.

The system may comprise a springy cover that may be stretched over the hull of the folded boat.

In certain positions in the springy substance, material may have been fitted that may serve as a bumper for the boat when the springy substance has been tensioned around the hull of the boat. Specific and preferable aspects of the invention have been included in the attached independent and dependent claims. Features of the dependent claims may be combined with features of the independent claims and with features of other dependent claims such as indicated and not only as expressly brought forward in the claims.

These and other aspects of the invention will be apparent from and be clarified by reference to the embodiment(s) described below.

SHORT DESCRIPTION OF THE FIGURES

Figure 31A:
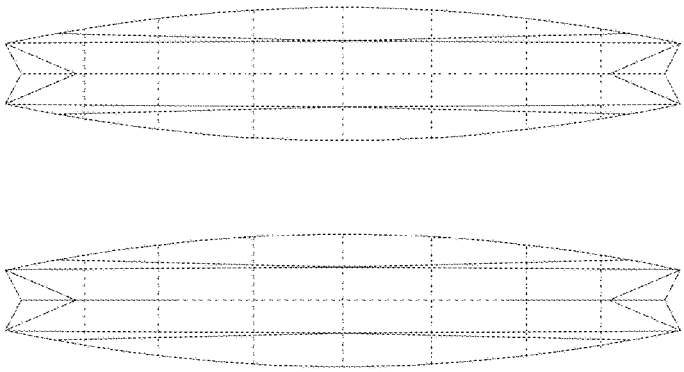
Figure 31B:
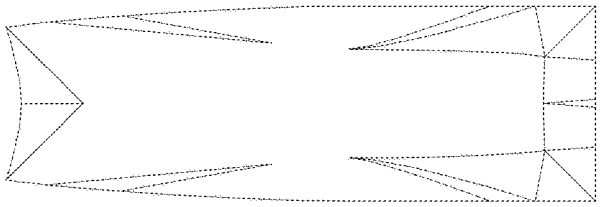
Figure 31C:
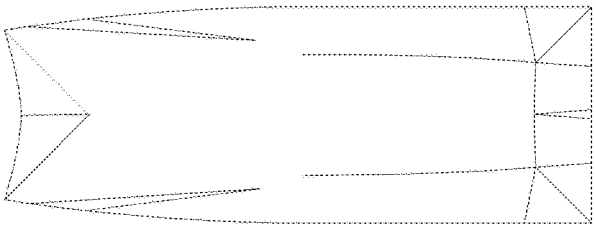
Figure 32:
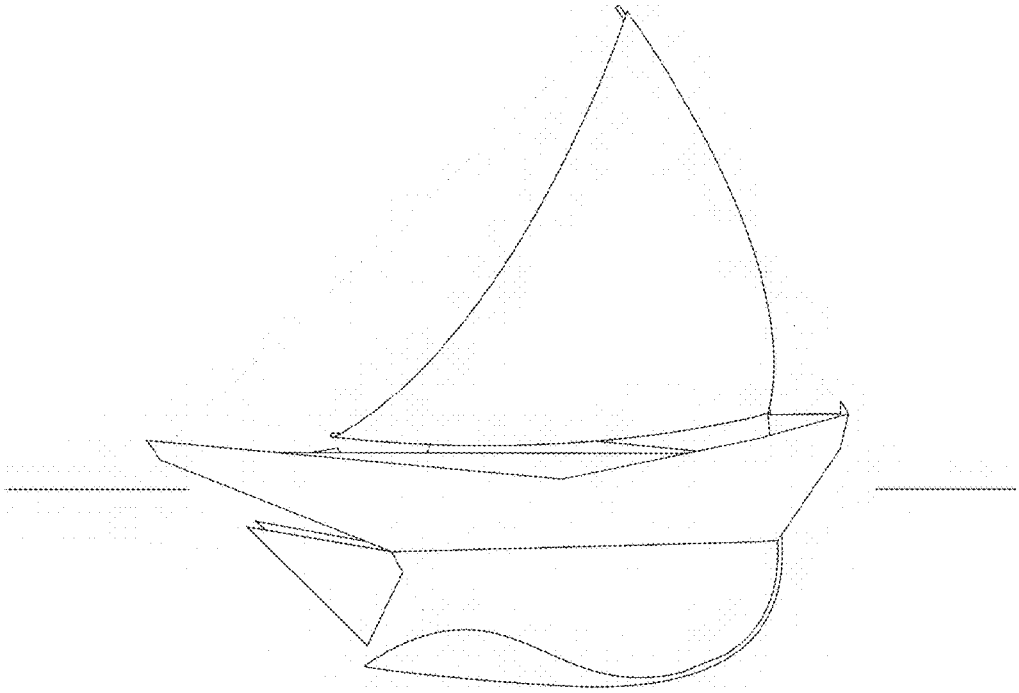

FIGS. 31(A) to 31(*c*) and FIG. 32 illustrate alternative watercraft according to embodiments of the present invention.

Figure 33:
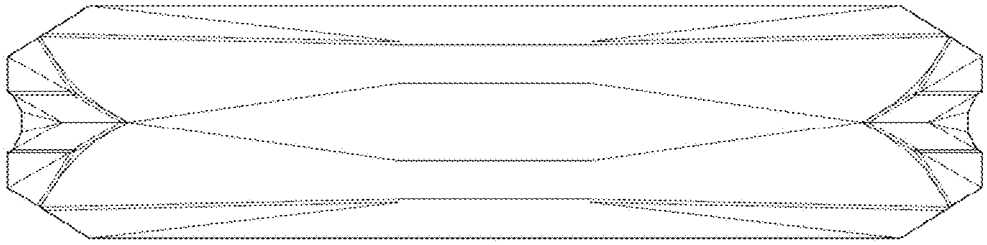

FIG. 33 illustrates an embodiment of the present invention, whereby a specific surface is provided that may be folded as a transverse section into the nose of the watercraft.

Figure 34:
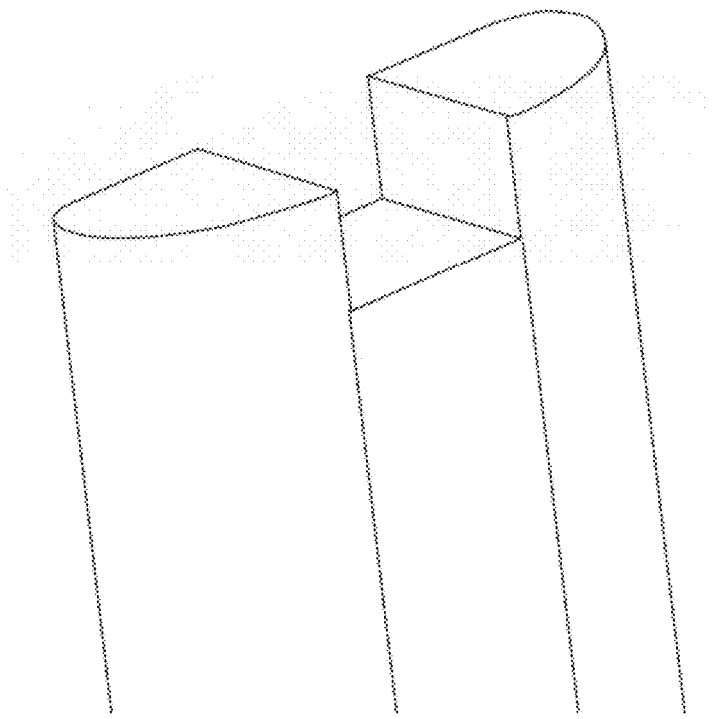

FIG. 34 illustrates a middle bow usable in a foldable watercraft according to the present invention.

The figures are only schematic and not restrictive. It is possible that, in the figures, the dimensions of some components have been exaggerated and have not been represented to scale for illustrative purposes.

Reference numbers used in the claims cannot be interpreted to restrict the scope of protection. In the various figures, the same reference numbers refer to the same or similar elements.

DETAILED DESCRIPTION OF ILLUSTRATIVE EMBODIMENTS

The present invention will be described in respect of special embodiments and with reference to certain drawings, however the invention will not be restricted to this but will only be restricted by the claims. The drawings described are only schematic and not restrictive. In the drawings, the dimensions of some elements have been enlarged and have not been drawn to scale for illustrative purposes. The dimensions and the relative dimensions sometimes do not correspond with the up-to-date practical embodiment of the invention.

Furthermore, the terms first, second, third and the like in the description and in the claims are used to distinguish similar elements and are not necessarily used for describing an order, nor in time, nor in space, nor in ranking nor in any other manner. It should be understood that the terms used in this way are interchangeable in appropriate circumstances and that the embodiments of the invention described are suitable to work in a different order than described or indicated herein.

Moreover, the terms top, bottom, above, in front of and the like used in the description and the claims are used for description purposes and not necessarily to describe relative positions. It should be understood that the terms used as such in given circumstances may be interchanged and that the embodiments of the invention described herein are also suitable for functioning according to orientations other than described or indicated herein.

It should be noted that the term "comprises", as used in the claims, should not be interpreted as being restricted to the items described thereafter; this term does not exclude any other elements or steps. It may be interpreted as specifying the presence of the features, values, steps or components indicated which are referred to but does not exclude the presence or addition of one or several other features, values, steps or components, or groups thereof. So, the extent of the expression "a device comprising items A and B" should not be restricted to devices consisting of components A and B only. It means that in respect of the present invention, A and B are the only relevant components of the device.

Reference throughout this specification to "one embodiment" or "an embodiment" means that a specific feature, structure or characteristic described in connection with the embodiment has been included in at least one embodiment of the present invention. So, the occurrence of the expressions "in one embodiment" or "in an embodiment" in various locations throughout this specification do not necessarily need to refer to the same embodiment all the time, but can do so. Furthermore, the specific features, structures or characteristics may be combined in any suitable manner as would be clear to a person skilled in the art on the basis of this publication, in one or several embodiments.

Similarly, it should be appreciated that in the description of sample embodiments of the invention, various features of the invention are sometimes grouped together in one single embodiment, figure or description thereof intended to streamline the publication and to help the understanding of one or several of the various inventive aspects. This method of publication should therefore not be interpreted as a reflection of an intention that the invention requires more features than explicitly mentioned in each claim. Rather, as the following claims reflect, inventive aspects lie in fewer than all features of one single previously publicised embodiment. So, the claims following on from the detailed description have been explicitly included in this detailed description, with every independent claim being a separate embodiment of this invention.

Furthermore, while some embodiments described herein comprise some, but not other, features included in other embodiments, combinations of features from various embodiments are intended to be within the scope of the invention, and these form various embodiments as would be understood by the person skilled in the art. For example, in the following claims, any of the embodiments described may be used in any combination.

In the description provided here, a large number of specific details are raised. It may therefore be understood that embodiments of the invention may be embodied without these specific details. In other cases, well-known methods, structures and techniques have not been shown in detail in order to keep this description clear.

Where reference is made in embodiments of the present invention to the "fold angles", the angles in the panel are meant which are formed when the panel is folded into watercraft. These are the angles along the folds.

Where reference is made in embodiments of the present invention to "the nose" of a watercraft, the bow and/or stern of the watercraft is meant.

Where reference is made in embodiments of the present invention to the "width of a pleat line", the distance measured between the two extreme points of the angle lines of the cross-section of the pleat line is meant.

Where reference is made in embodiments of the present invention to the "distance between two pleat lines", this is measured between the extreme points of the angle lines of the cross-sections of the pleat lines, whereby the angle line of the one pleat line and the angle line of the other pleat line are chosen such that they are the angle lines that are located closest to one another.

When reference is made in embodiments of the present invention to a fold, it may therefore be made up of a single or a double pleat line (or possibly even yet further pleat lines).

Where reference is made to folds making contact with one another under a sharp angle, reference may be made to folds making contact with one another under an angle smaller than 90°, advantageously smaller than 45°, more advantageous smaller than 30°, such as for example smaller than 20°.

In a first aspect, the present invention provides a system that is foldable into an open-top watercraft, such as a fishing boat or a canoe. The system comprises a watertight panel in which folds have been made such that the panel may be folded into an open-top watercraft from a flat state. According to embodiments of the present invention, the panel comprises a set of folds as a result of which the watercraft, once it has been folded into watercraft, has a bottom having a flat profile in the longitudinal direction or a convex profile relative to the watercraft. This shape may be achieved by providing at least two subsets of folds, positioned at either sides of an extremity of a watercraft, in which each of the subsets of folds comprises a first and a second fold which are substantially in the longitudinal direction of the boat, whereby the first and the second folds are not in parallel but make contact with one another under a sharp angle, and whereby those folds may be pleated such that the side wall of the watercraft, after it has been folded, is locally formed by three overlapping layers of the watertight panel, i.e. a zigzag pleat is formed. The specific folding pattern results in the specific shape of the bottom and ensures that a great stability is achieved, which is not an easy task for open-top watercraft such as canoes and fishing boats.

As an illustration, the present invention therefore not being restricted, the various elements, aspects and advantages of embodiments of the present invention will be further described with reference to a number of figures showing examples of embodiments.

The watertight foldable system according to embodiments of the present invention typically comprises a watertight panel of which the watercraft may be folded. This panel may consist of just one layer or several layers. In case the panel consists of just one layer, this layer must be a watertight layer comprising a certain rigidity. This may for example be made from PVC and/or polyester and/or polypropylene, it may for example be made from a corrugated polypropylene plate commercially known under the name of Biplex or from a plate having a cell structure commercially known under the name of Bicell. In some embodiments of the present invention, the panel comprises several layers. For example, a first bendable layer (e.g. PVC, polyester, coated fabric, Curve) and a second non-bendable layer. The one layer is typically more rigid than the other layer. The first layer may for example be fixed onto the second layer by lamination. This may for example happen by hot or cold lamination. In some examples, the two layers are for example melted together under increased pressure and increased temperature (hot lamination). There may possibly additionally be made use of a layer of glue in between. The first layer may also be glued onto the second layer or the second layer may be fixed onto the first layer using 3D printing techniques. In some embodiments, the more rigid layer is a honeycomb structure.

In embodiments of the present invention, the first layer has a thickness of between 0.3 mm and 2.0 mm preferably between 0.6 mm and 0.8 mm. The advantage of a thicker second layer is that a greater rigidity may be achieved. Preferably an optimum is chosen between a layer with great rigidity and a layer with good foldability and sufficiently low weight. When the panel according to the present invention consists of two layers, a combination of good rigidity, foldability and watertightness is achieved in any case.

The second layer may have a honeycomb pattern. The cells in it are each individually sealed cells. When a hole is made into the panel, the other cells are still intact and still contain air such that the floatability of the cells not impacted by the hole does not decrease.

In order to make a panel comprising 2 layers foldable, the panel is made from a second layer with a first layer on top that is foldable. On the pleat lines, material of the second fold layer is removed or during the production will be provided that less material is present there—or over a part of the thickness of the second layer, or fully—such that less space becomes available to fold the panel around the pleat lines and such that due to the reduced thickness of the second plate, it becomes foldable. By removing material, the stress, which would be built up in the second plate by folding it, is reduced or even fully removed. The flexible first layer serves as hinge point hereby. In here, no indentations must be made to enable folding such that the panel 110 remains watertight.

In embodiments of the present invention in which the panel consists of two layers, the second layer 112 is a plate grooved from a double-wall corrugated polypropylene plate. These plates are also referred to as channel plates.

In embodiments of the present invention, this double-wall corrugated polypropylene plate may also be used as single layer. In embodiments of the present invention, the second layer 112 has a cell structure. The cell structure may for example be a honeycomb structure. The material which the cell structure is made of may for example be polypropylene. In embodiments of the present invention, the second layer 112 is a double-wall polypropylene plate with a honeycomb structure inside. In embodiments of the present invention, the panel is fully made from polypropylene. It is an advantage hereby that the panel is recyclable. In embodiments of the present invention, the panel 110 comprises a composite consisting of a flexible base layer with for example a plastic structure on it. This plastic structure may for example have been fixed by means of 3D printing techniques.

Figure 1:
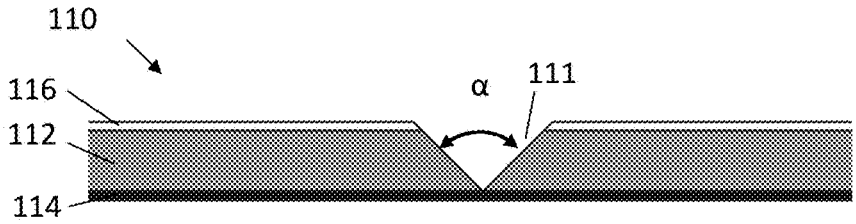
FIG. 1 shows the cross-section of a panel including a pleat line with a 90° angle in accordance with embodiments of the present invention.

In some embodiments of the present invention, a pleat line is made by removing a wedge shape from the second layer. The angle of that path may for example be between 20° and 130°, for example between 40° and 110°, for example between 80° and 100°, for example 90°. An example of this can be seen in FIG. 1 showing the cross-section of a panel 110 according to an embodiment of the present invention. The panel consists of a first flexible watertight layer 114 and a second more rigid layer 112 shielded by a third layer 116. In this example, the first layer 114 is a 0.8 mm thick dark-grey PVC-coated polyester layer. In this example, the second layer 112 is a 7 mm layer with a honeycomb pattern. On here, a third layer 116 of rigid PVC material has been fitted. This may for example happen by means of lamination. In some embodiments, a PVC-coated polyester layer is attached to a polyester non-woven microfleece layer.

A pleat line 111 has been made into the second layer 112 and in this example through the third layer 116. This pleat line 111 has an angle a $\alpha$ of 90°. As a result, the panel may be folded such that the section along the one side of the pleat line forms a 90° angle with the section along the other side of the pleat line. A fold in this direction may serve as inner fold 130. In this case, after folding, the first layer 114 is on the outside of the angle. The angle which may be formed by the folded panel is a 90° angle in this case.

Figure 2:
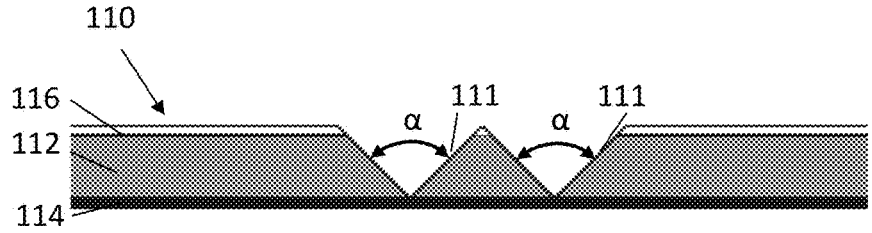
FIG. 2 shows the cross-section of a panel including two pleat lines each with a 90° angle in accordance with embodiments of the present invention.

FIG. 2 illustrates a panel in which 2 pleat lines have been made next to one another in the panel 110. In this embodiment, both pleat lines 111 make contact. Both pleat lines 111 have an angle $\alpha$ of 90°. A fold in this direction may again serve as inner fold 130. As a result, the one side of the panel may be folded in parallel with the second side of the panel. In other words, an inner fold of 180° is formed. Hereby the fold is such that the outer side of the folded panel 110 is formed by the first layer 114.

Figure 3:
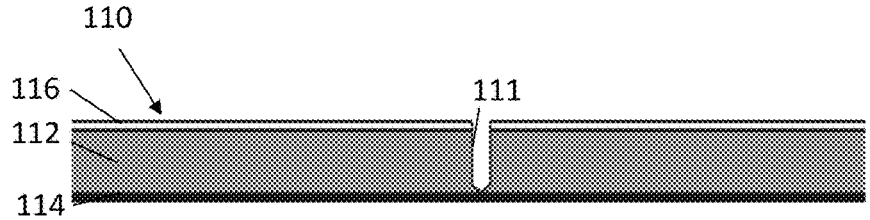
FIG. 3 shows the cross-section of a panel including a pleat line with a 0° angle in accordance with embodiments of the present invention.

When a panel with two layers is used, a pleat line may also be made by making a cut in the second layer or by fully cutting this through, whereby no angle is present in the cut. This cut with an angle $\alpha$ of 0°, in other words, does not allow for an inner fold 130 to be made but does allow an outer fold 140 to be made. In the case of an outer fold, the panel will be folded around the pleat line such that the first layer 114 is on the inside of the angle. FIG. 3 shows an embodiment of the present invention whereby the pleat line 111 is a cut in the second layer. The panel 110 may be folded such that the one side of the panel 110 in parallel with the second side of the panel 110 and that the first layer 114 is on the inside of the fold.

As described above, for a watertight structure, according to embodiments of the present invention, the panel 110 comprises a set of folds 120 such that the watercraft, after the watercraft has been folded, has a bottom which has a flat profile in the longitudinal direction or a convex profile relative to the watercraft. This may be achieved by providing at least two subsets of folds 120, positioned to either sides of an extremity of a watercraft, but preferably four subsets, and one to each side of each extremity of the watercraft, which comprise a special folding pattern. Each subset of folds 120 thereby comprises a first and a second folds 120 which are substantially positioned in the longitudinal direction of the boat, whereby the first and second folds 120 are not in parallel but touch each other under a sharp angle, and whereby the folds 120 may be pleated such that the side wall of the watercraft, once it has been folded, are folded locally by three overlapping layers of the watertight panel.

Figure 4:
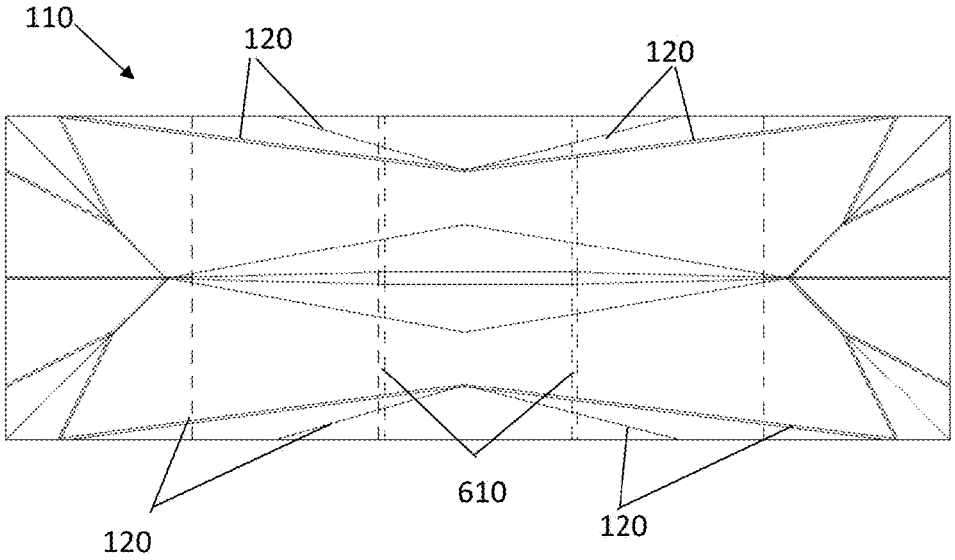
FIG. 4 shows the top view of a panel according to embodiments of the present invention.

The first and the second folds 120 preferably start from the edge of the panel, when it is in folded-open state. The contact point of the two folds is more central in the panel than the other extremities of the fold lines starting from the edge. The first fold 120 may be formed by two adjoining pleat lines. As an illustration, FIG. 4 shows a panel 110 according to embodiments of the present invention. The uninterrupted individual lines in the figure are some pleat lines. The forms 120 together shape one subset of folds 120 affecting the shape of the bottom. From the folding pattern in FIG. 6 may be seen that in the example of this embodiment, four of these subsets have been provided. By folding the panel according to these lines, a canoe is achieved with a bottom having a neutral or positive curve such that the centre of the watercraft, when it is in the water, is deeper than other positions in the longitudinal direction of the boat. The dotted lines are folds 610 which serve for folding up the watercraft (which will be further discussed below). In this example, the panel has a size of 365×125 cm. This results in a canoe with a length of approximately 3 m.

Figure 5:
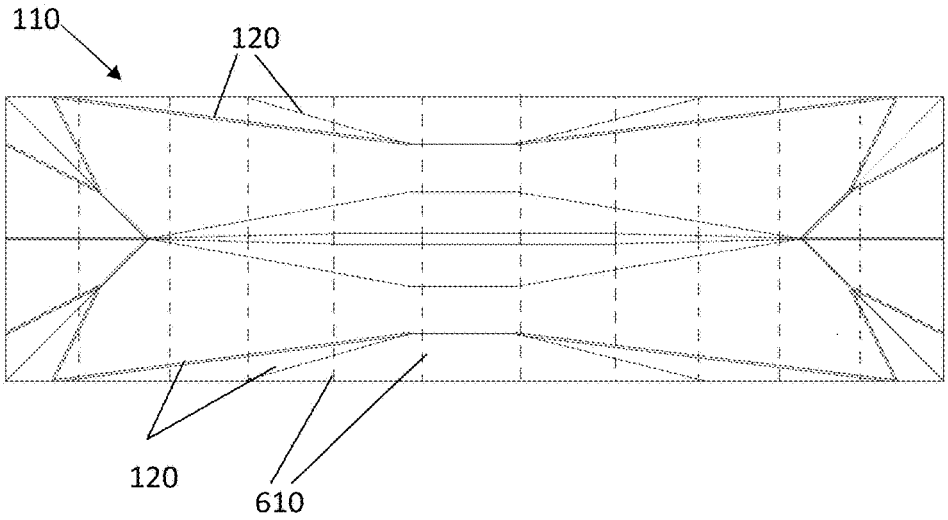
FIG. 5 shows the top view of a panel that is larger than the panel of FIG. 4 according to embodiments of the present invention.

FIG. 5 shows the top view of a panel 110 according to embodiments of the present invention. In this example, the panel 110 has a size of 525×125 cm. This results in a canoe with a length of approximately 5 m. The folding pattern comprising folds has been adapted in the middle of the canoe relative to the folding pattern in FIG. 4 such that, when folded, a better sitting space is achieved. Not all folds in the figure have been indicated by a reference number in order to keep the figure clear. The dotted lines show the folds 610 along which the panel 110 may be folded up into a compact transport shape.

In some embodiments of the present invention, the folding pattern also comprises folds 120 for specifically folding the nose of the watercraft. The nose may refer to the extremity of the watercraft. The specific folds may be provided at either sides of the panel such that either extremities may be folded in the same manner. In some embodiments, at least one nose of the watercraft is formed by at least 3, for example at least 7 folds. In some embodiments, this may result in the fact that at the nose, at least 4, for example at least 8, for example at least 10 layers of the panel come together. The folding pattern according to the embodiments of the present invention may be such that at least one of the noses is formed from one extremity of the panel consisting of contiguous sections. The noses shape the bow and the stern respectively of the watercraft. In embodiments of the present invention in which only one nose has been folded, this watercraft may concern a watercraft with open stern. In some embodiments, a set of pleats is provided in the pleating pattern such that, when folded, the boat has a section in the nose that is substantially in the latitudinal direction of the watercraft. This results in less sharp point inwards and a sturdier nose construction. The pleat pattern is illustrated in FIG. 33. In embodiments of the present invention, the panel is a flat panel. In embodiments of the present invention, the panel is a rectangular panel.

Figure 6:
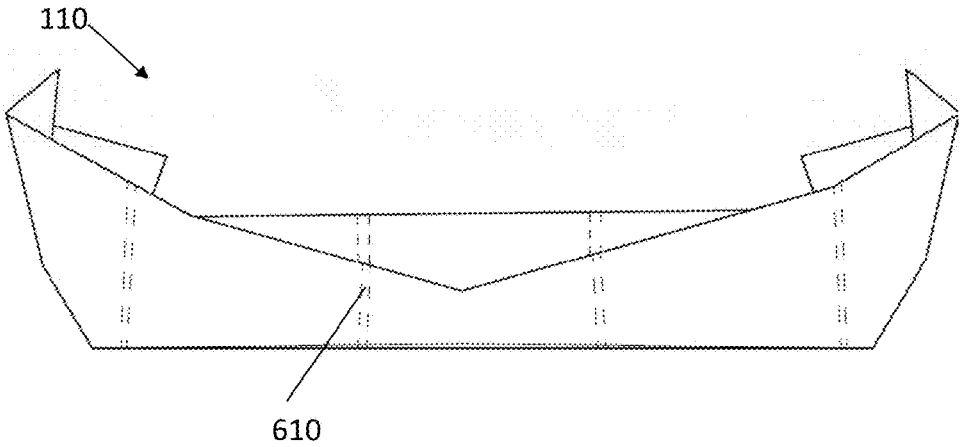
FIG. 6 to FIG. 12 show the various steps of unfolding a watercraft up to folding up the panel to a more compact shape according to embodiments of the present invention.
Figure 7:
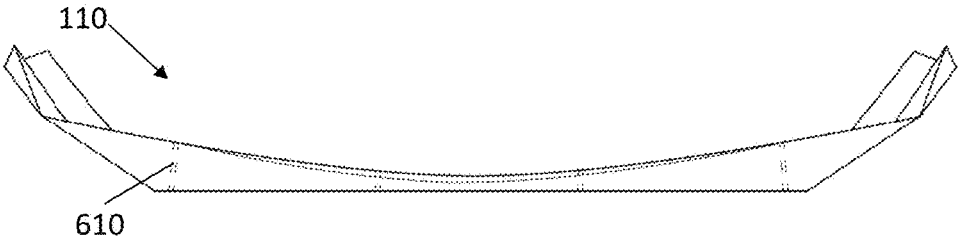
Figure 8:
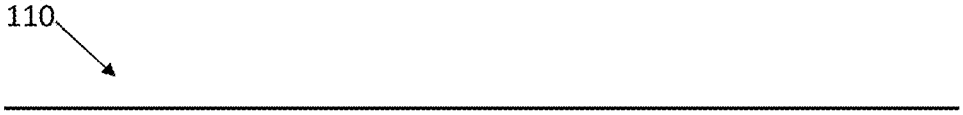
Figure 9:
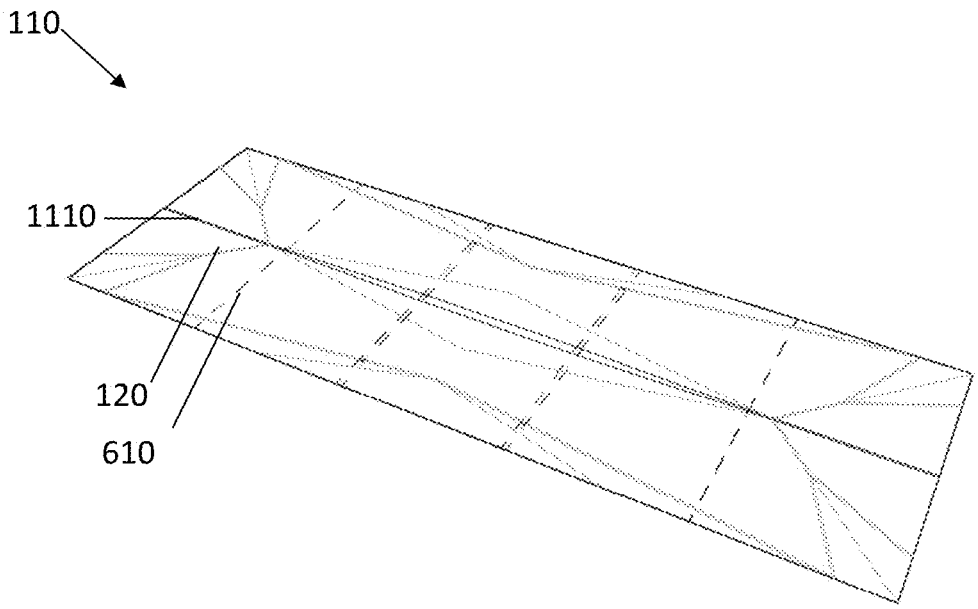
Figure 10:
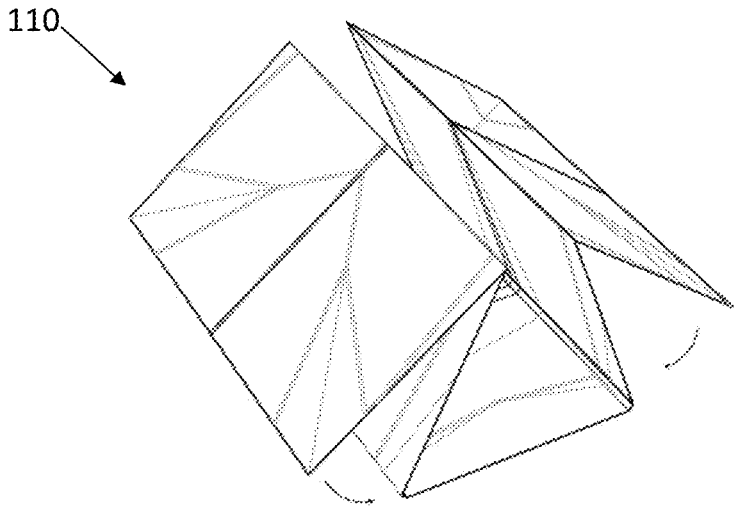
Figure 11:
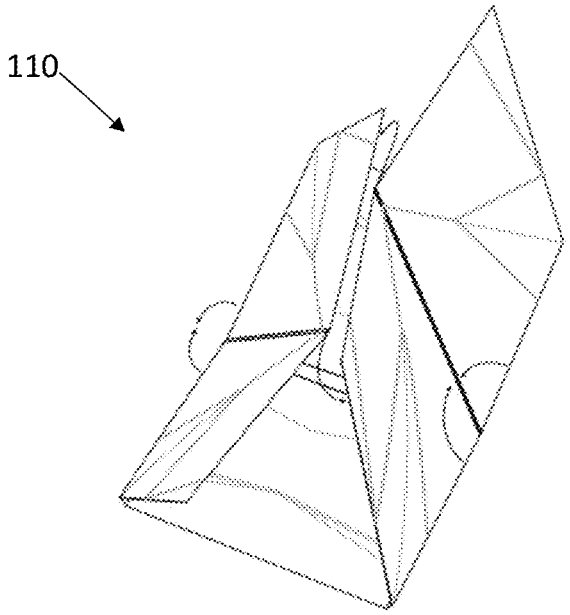
Figure 12:
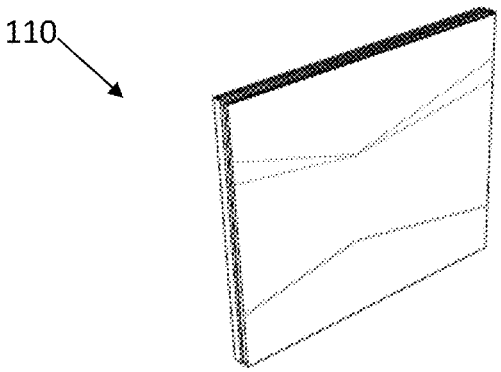

FIG. 6 to FIG. 12 show the various steps from unfolding a watercraft to folding up the panel into a more compact shape. FIG. 6 shows a side view of a panel 110 folded into a canoe according to an embodiment of the present invention. The folds that will be used for folding up the panel 110 are also visible in the figure. FIG. 7 shows a side view of a partially unfolded panel 110. The dotted lines represent the folds 610 along which the panel 110 may be folded up into a compact transport shape. FIG. 8 shows a side view from a fully unfolded canoe to a panel 110. FIG. 9 shows a top view of a panel 110 according to embodiments of the present invention. The dotted lines 610 show the folds along which the panel will be folded up into a more compact shape. The full lines are the folds 120 along which the panel is folded into canoe. The middle full lines in the longitudinal direction 1110 also serve as folds along which the panel is folded up into a more compact shape. FIG. 10 shows a 3D image of a partially folded-up panel and FIG. 11 shows a 3D image of a panel 110 that is folded up a little more. FIG. 12 shows a 3D image of a fully folded-up panel 110 according to embodiments of the present invention.

The size of the watercraft may for example be between 2 and 6 m. The watercraft may for example have a length of approximately 5 m (typically a large watercraft) or may for example have a length of approximately 3 m (typically a small watercraft). It is an advantage of embodiments of the present invention that the weight of the boat may be restricted. The weight of the boat may for example be between 10 and 20 kg, a large boat may for example have a weight of approximately 17 kg or even less than 17 kg, and a small watercraft may for example have a weight of approximately 12 kg or even less than 12 kg. The load capacity of a small boat may for example be up to 200 kg. A small boat may for example carry two people or one person and luggage. The load capacity of a large boat may for example be up to 300 kg. A large boat may for example carry two people and the luggage for two people or three people.

In embodiments of the present invention, in addition to folds allowing for the panel to be folded into a watercraft, optionally also folds have been made allowing for the panel to be folded up into a more compact shape than when the panel is fully unfolded into the intended system shape, for example into boat shape. Such a more compact shape may for example be a box shape. In an embodiment of the present invention, a small watercraft with a length of approximately 3 m may be folded up such that it changes into a box shape of approximately 125×40×15 cm. In an embodiment of the present invention, a large watercraft with a length of approximately 5 m may be folded up such that it changes into a box shape of approximately 125×40×20 cm. It is an advantage of embodiments of the present invention that the boat may be narrow in transport shape.

Figure 13:
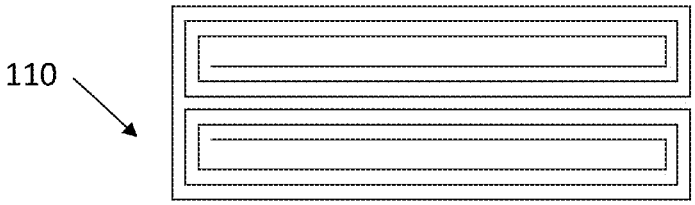
FIG. 13 shows the cross-section of a spiral-shaped folded-up panel according to embodiments of the present invention.

In embodiments of the present invention, the panel may therefore comprise several folds in the latitudinal direction such that the panel may be folded up into a transport shape for transporting the foldable watercraft, the length of the transport shape of which corresponding with the width of the folded-out panel. The folds 610 may be made in the transverse direction such that when the panel is folded up, hollow spaces are present inside the folded-up panel. The folds may therefore have been made such that, when the panel is folded up around these folds, hollow spaces are created in the folded-up panel. These may be used for storing material in. In embodiments of the present invention, folds 610 may be in the latitudinal direction such that the panel may be folded up into a single or a double spiral shape. Inside the spiral, spaces may thereby be provided in which extra material may be placed. FIG. 13 shows the cross-section of a spiral-shaped folded-up panel 110 according to embodiments of the present invention.

In embodiments of the present invention, some folds along which is folded to fold the panel into a structure, for example watercraft, are also used as fold to fold up the panel into a more compact shape (for example a box).

In embodiments of the present invention, a shielding may be closely fitted to the folded-up panel. This shielding may for example be a carrying bag. The folded-up panel may then be placed into a carrying bag to transport it. Such a carrying bag may for example be a piece of fabric that may be folded around the folded-up panel. The carrying bag may for example be made from cordura fabric. On here, straps may have been stitched to be able to bind the whole together (for example clip buckles with tension lock). Carabiners may for example be provided with a number of buckles from the carrying bag in order to be able to carry the carrying bag. As the carrying bag in embodiments of the present invention is made from a flat piece of fabric, it may also serve as a ground sheet, for example a ground sheet of a tent. In embodiments of the present invention, two boats may be converted into a tent by means of a number of accessories. This may for example be achieved by attaching two unfolded plates together by means of for example a rubber connecting piece making the seam between the two plates watertight. Additional sheets are further used to seal the front and rear. The advantage of such a construction is that no tent poles are required, the tent is highly resistant to adverse weather and so no extra tent needs to be carried along when one has two boats at their disposal. The hulls of the boats will therefore form a part of the outer sheet of the tent then. The carrying bag may form the ground sheet of the tent.

The shielding for shielding the folded-up panel may for example be a flexible sheet or a rigid sheet of any protective material. The shielding may be attached using the tension straps which are also used for reinforcing the watercraft and which in that case will be tensioned in a cross from one side of the watercraft to the other side of the watercraft.

Figure 14:
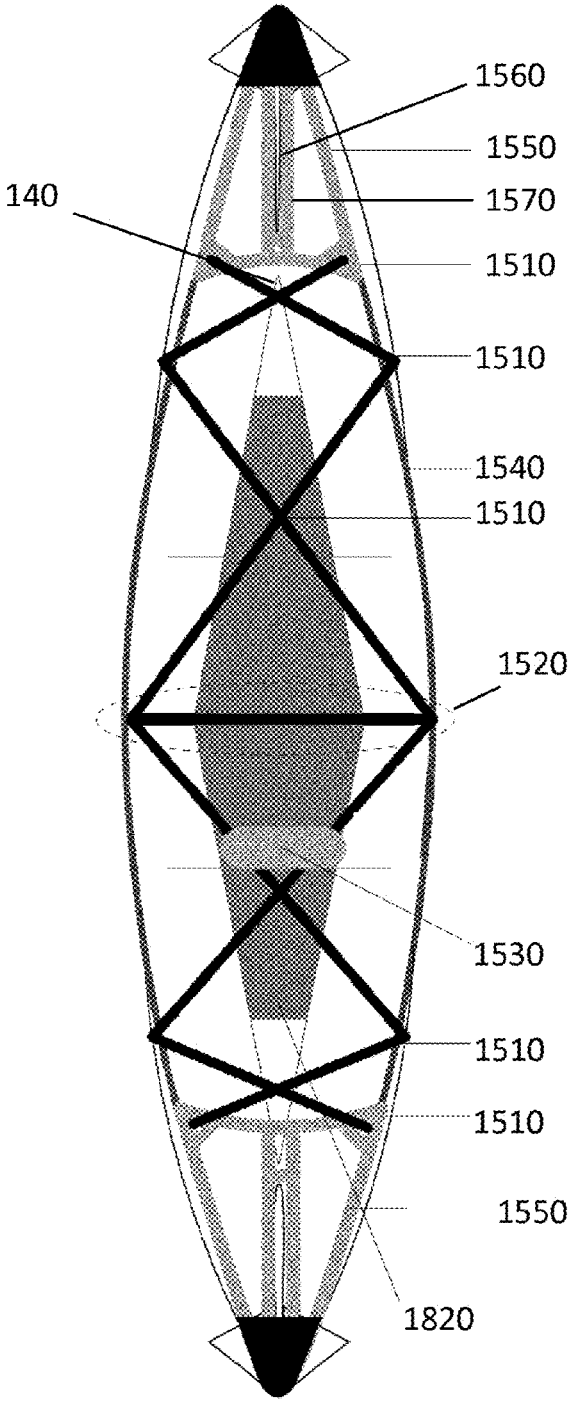
FIG. 14 shows the top view of a watercraft according to an embodiment of the present invention.

FIG. 14 shows the top view of a watercraft according to an embodiment of the present invention. In the watercraft, tensioning straps 1510 have been fixed which have been tensioned from one side to the other side of the folded boat. In the present invention, these tensioning straps 1510 have been fitted such that they cross each other in the middle of the watercraft. Over the full length of the watercraft, four pairs of tensioning straps 1510 have been fitted. The tensioning straps 1510 closer to the bow or the stern of the watercraft are tensioned over a shorter longitudinal distance of the watercraft than the tensioning straps that are closer to the middle. Depending on the shape of the watercraft, the position of the tensioning straps 1510 and the number of tensioning straps may vary. The tensioning straps may for example be attached to the watercraft by means of tension locks. The tensioning straps may for example be polyester tensioning straps having a width of 2.5 mm.

The cross of two tensioning straps 1510 may be used to support the buttocks while rowing (for example when rowing is done in the knee position). It is an advantage of embodiments of the present invention that a knee position is ergonomically the healthiest way of rowing a canoe. The position of the cross of the tensioning straps may be changed by means of the tension locks. As a result, the position of the rower may be adapted slightly (e.g. in height over a distance of 10 cm) in order to prevent stiffness in the body. Depending on whether one or two people are rowing, the position of the crossing straps may be amended. In FIG. 14, seats 1530 have been fitted at the level of the crossing of the middle tensioning straps 1510. These seats rest on the tensioning straps 1510 and may be used as support when rowing. These seats may for example be made from EVA (ethylene vinyl acetate).

Figure 24:
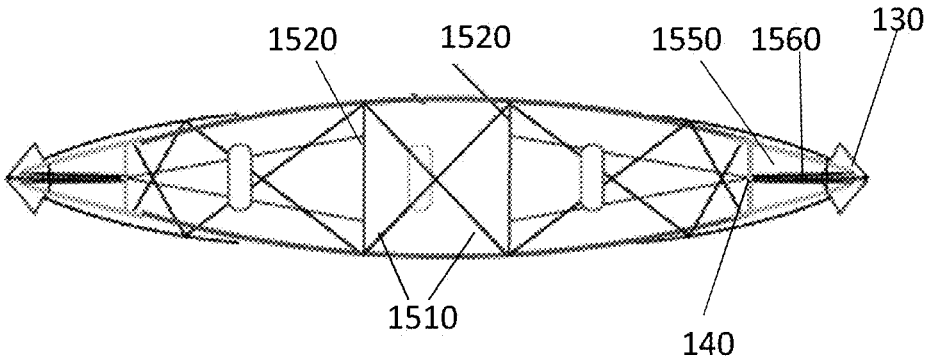
FIG. 24 shows the top view of a watercraft according to an embodiment of the present invention.

FIG. 14 also shows a spacer 1520 which is positioned between the one side of the watercraft and the other side of the watercraft. This spacer 1520 may for example be an aluminium tube. Other materials such as for example wood, PVC (polyvinyl chloride) or reinforced polypropylene are possible too. In other embodiments of the present invention, this spacer 1520 may for example also be a telescopically extendible walking stick or a photo monopod. In this case, any associated accessories are provided that allow the walking stick or the monopod to be fitted to the side walls of the watercraft. In embodiments of the current invention, several spacers and extra tensioning straps may have been fitted. FIG. 24 shows the top view of a boat according to embodiments of the present invention. In this figure, two spacers 1520 are present and there is an extra cross of tensioning straps 1510 between the spacers.

Embodiments according to the present invention optionally comprise a corner plate 1550 which may be placed at the front or at the rear of the watercraft. An example of this is shown in FIG. 14. When positioned, the corner plate closely meets the inside of the folded boat. In this example, the folded boat has a main pleat 1560 both at the front (the bow) and at the rear (the stern). This is a pleat folded inwards. Next to the main pleat, there may still be additional pleats folded inwards present to form the nose and/or the stern. In general, the folds of a pleat folded inwards 1560 describe at least 2 inner folds 130 and 1 outer fold 140. When the panel 110 is a panel with 2 layers, a main pleat 1560 may be achieved by means of two double pleat lines (for the inner folds 130) and one cut the angle of which is 0° (for the outer fold 140). By forming the pleat folded inwards, a part of the panel 110 has been folded inwards to make the bow and the stern point-shaped. With this main pleat 1560, a part of the panel to the one side of the panel closely meets the other side of the fold when the panel is folded into boat shape. Both sides will then be parallel to one another. In embodiments of the present invention, an indentation 1570 is present in the corner plate 1550. This may for example be a slot. This indentation 1570 is placed such that it fits around the main pleat 1560 when the corner plate is positioned to the front or rear of the watercraft. It is thereby an advantage of embodiments of the present invention that the main pleat 1560 is kept together by the indentation 1570 in the corner plate. A corner plate 1550 may for example be attached to the watercraft using tensioning straps. In embodiments of the present invention, for each pleat folded inwards, a corresponding indentation is present in the corner plate 1550.

Figure 15:
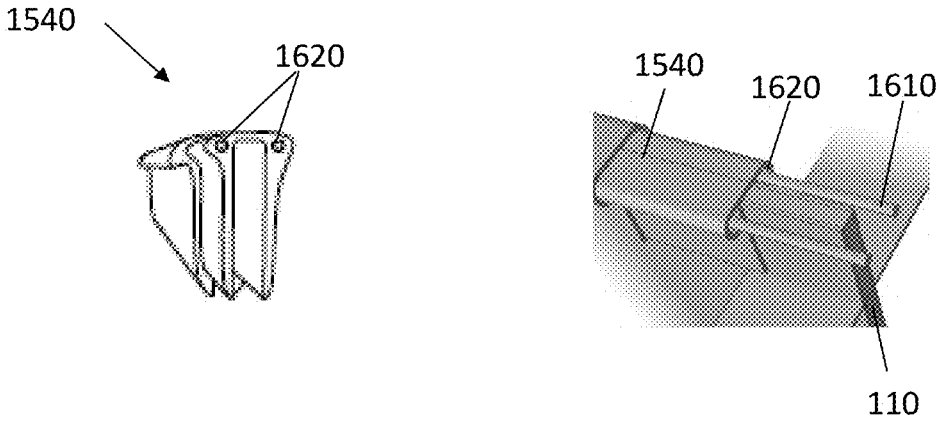
FIG. 15 shows two 3D drawings of an edge that is slidable across according to embodiments of the present invention.

Embodiments of the present invention comprise edges 1540 that are slidable across that may be slid over the sides (the gunwales) of the watercraft. These edges that are slidable across serve as reinforcement of the watercraft. An example of such an edge 1540 that is slidable across is shown in FIG. 15. Both the left and the right figures show a 3D drawing of an edge 1540 that is slidable across. These edges that are slidable across may comprise various part elements which may be slid into one another to create one large edge that is slidable across. Sliding in and out of one another of the edges 1540 that are slidable across may possibly happen according to the same principle as is common for tent poles. The right figure shows an edge that is slidable across on the edge of a panel 110. In this example, the edge 1540 that is slidable across may consist of two parts that may be slid into one another. In the edge that is slidable across, openings 1620 are present in the longitudinal direction in which elastics 1610 may be stuck in order to keep the edges that are slidable across, tensioned into one another.

Figure 16:
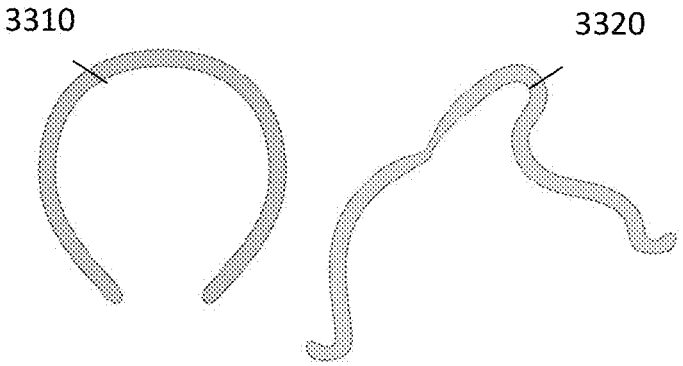
FIG. 16 shows the cross-section of an inner part and the cross-section of an outer part of a part element of an edge that is slidable across according to embodiments of the present invention.
Figure 17:
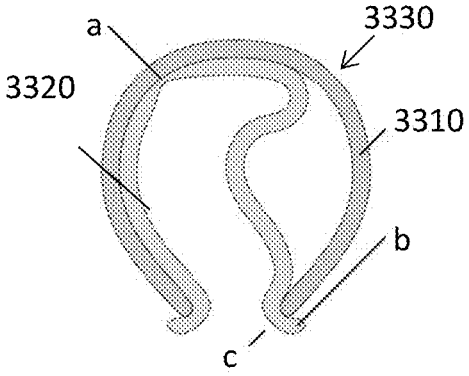
FIG. 17 shows the cross-section of a part element of an edge that is slidable across which consists of an outer part and an inner part according to embodiments of the present invention.
Figure 18:
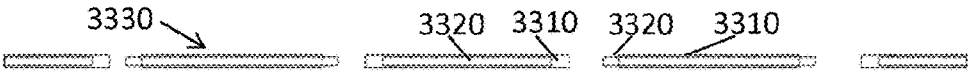
FIG. 18 shows a longitudinal section of a number of part elements of an edge that is slidable across according to embodiments of the present invention.

In some embodiments of the present invention, the part elements of the edge that is slidable across are achieved as follows (FIG. 16, FIG.17, FIG. 18). A narrowed side of a first part element 3330 may be slid into the non-narrowed side of a second part element 3330 (FIG. 18). In embodiments of the present invention, these part elements consist of an inner part 3320 and outer part 3310 with a certain shape. The outer shape 3310 is non-reshapable. The inner shape 3320 is made in a raised configuration and comprises one thinner part (indicated by b in FIG. 17) along which it may easily be pressed together by hand (the material must therefore not be brittle) and be positioned in the outer shape. When the inner shape, after having been positioned, is no longer pressed together, it exercises an outward pressure onto the outer shape, so that it stays stuck. The inside of the whole has been made smooth and comprises an opening which clamps just across the side wall of the watercraft. At the opening side of the inner shape 3320, the lips of the inner shape may open to the outside such that, provided sufficient pressure is exercised, they may be opened (see also position c in FIG. 17). This allows for the edge that is slidable across to press over the side of the watercraft. The material of the inner shape 3320 may, in embodiments of the present invention, be chosen such that it may be pressed together (see for example position c in FIG. 17). As a result, the edge that is slidable across may slide more easily over the side of the watercraft. In embodiments of the present invention, the inner shape is positioned staggered into the outer shape as illustrated in FIG. 18. This allows for the part elements to be slid into one another. It is an advantage of edges that are slidable across according to embodiments of the present invention that these edges that are slidable across (inside and outside) may easily and cheaply be extruded and that no extra components are required to attach the various parts together. The outer dimensions of the outer shape may for example be between 3×3 cm and 7×7 cm (not necessarily circular), they may for example be 5×5 cm.

The spacer 1520 may, in embodiments of the present invention, also be attached to the edges 1540 that are slidable across.

Figure 19:
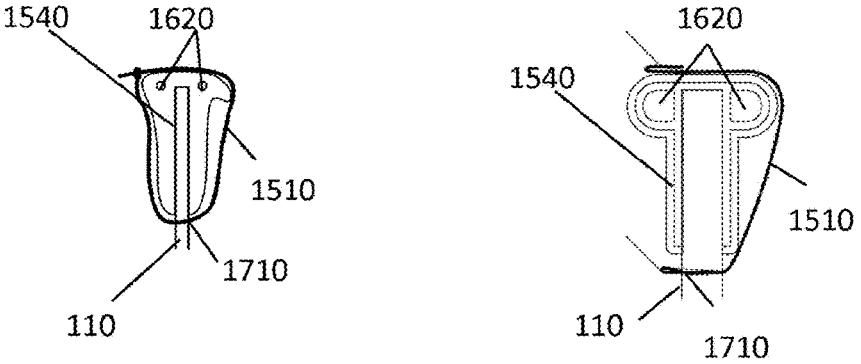
FIG. 19 shows the cross-section of a part of a panel with an edge that is slidable across according to embodiments of the present invention.

The tensioning straps 1510 may be attached to the edge of the watercraft by crevices 1710 in the panel 110 through which the tensioning straps may be stuck. Examples of this can be seen in FIG. 19. Both the left and the right drawings in FIG. 19 show the cross-section of a part of a panel 110 with an edge 1540 that on it is slidable across, with a tensioning strap 1540 around the edge and through a crevice 1710, in the panel 110. In embodiments of the present invention, the crevice 1710 has been reinforced. This may for example be with a plastic component. The drawings in FIG. 19 also show the openings 1620 in the edge 1540 that is slidable across in which the elastics 1610 may be stuck.

In embodiments of the present invention, one or several rafters are positioned across the watercraft. These rafters meet with the inside of the watercraft and ensure its reinforcement. They may for example have a U shape. In embodiments of the present invention, a rafter is attached in the boat by means of tensioning straps. In embodiments of the present invention, the rafter is positioned under the edges that are slidable across. This way, the rafter is clamped between the edges that are slidable across and the hull of the watercraft. In embodiments of the present invention, a groove is made into the rafter to attach accessories onto. The latter is shown as an illustration in FIG. 34. The rafter may for example be made from wood. This may for example be ply wood. This may for example be Finnish birch or beech.

Figure 20:
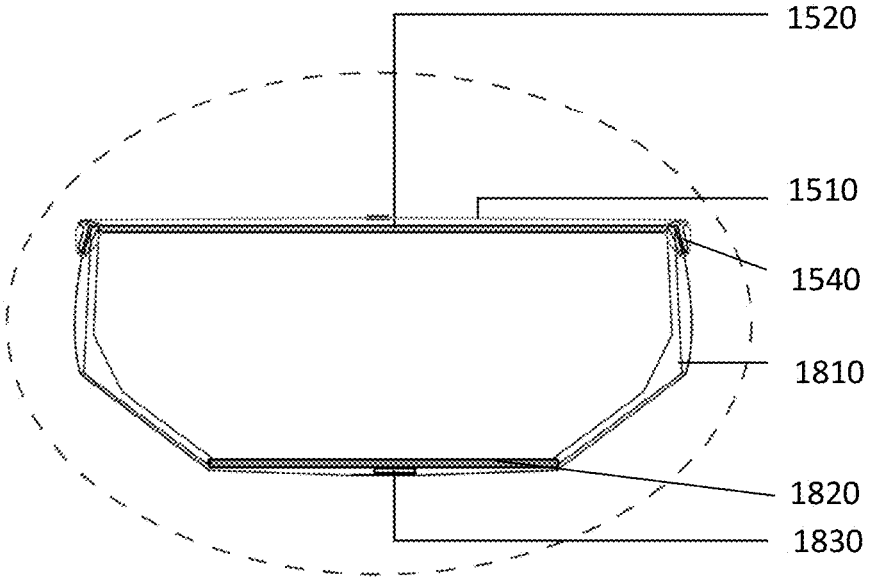
FIG. 20 shows the cross-section of a watercraft according to an embodiment of the present invention.

FIG. 20 shows the cross-section of a boat according to an embodiment of the present invention. In this figure, the cross-section of the watercraft from FIG. 14 is shown: the cross-section at the level of the spacer 1520. In this figure, the spacer 1520 can be seen as well as the edges 1540 that are slidable across. In this figure, two corner parts 1810 can be seen too, clamped between the edge that is slidable across and the base of the watercraft. These corner parts form raised walls along the inside of the watercraft. They reinforce the watercraft along the inside.

In embodiments of the present invention, a bottom plate 1820 may be fitted at the bottom in the watercraft, although this is not necessary for the stability of the watercraft. An example of this can be seen in FIG. 20. This may for example be a plastic bottom plate. The bottom plate may for example lean on a bottom slat. This bottom plate ensures reinforcement of the watercraft. This may for example be a honeycomb reinforced double-walled polypropylene plate. Herein too, folds may be made along which the bottom plate may be folded up. It is an advantage of embodiments of the present invention thereby that the bottom plate 1820 may be folded up to a more compact, more easily transportable shape. In embodiments of the present invention, panel 110 has been reinforced, for example in places which will form the ultimate bottom of the watercraft after folding, such that the ultimately folded boat may be sat in directly without a bottom plate being required.

Figure 21:
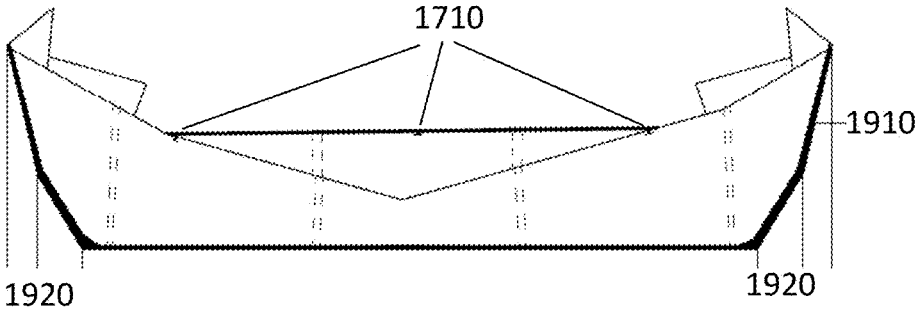
FIG. 21 shows a side view of a watercraft according to embodiments of the present invention.

In some embodiments of the present invention, the system comprises a springy substance 1910 with may be tensioned over the hull of the folded boat, although this is not strictly necessary. This springy substance 1910 may for example be made from rubber. An example of this is shown in FIG. 21. FIG. 21 shows a side view of a watercraft according to embodiments of the present invention. Furthermore, extra material may have been fitted in certain places in this springy substance that may serve as a bumper 1920. This may for example be hard plastic components. For this, various plastics may be used such as acrylonitrile butadiene styrene (ABS), polypropylene (PP) or polyvinyl chloride (PVC). When the springy substance 1910 has been put in place, extra material may extend across the entire length of the watercraft to form a bumper 1920 across the entire length of the watercraft. This extra material may furthermore also be positioned such that it may hold the springy substance 1910 in position when it is tensioned around the watercraft. It is an advantage of embodiments of the present invention that the springy substance holds the folding angles of the watercraft in their desired position. Furthermore, the extra material may have been fitted into the springy substance 1910 such that the folding angles are kept in position even better as a result. The hard plastic components may for example have been cast into a shape that closely meets the folding angle in its desired position. FIG. 21 also shows the crevices 1710 through which to stick tensioning straps 1510.

Figure 22:
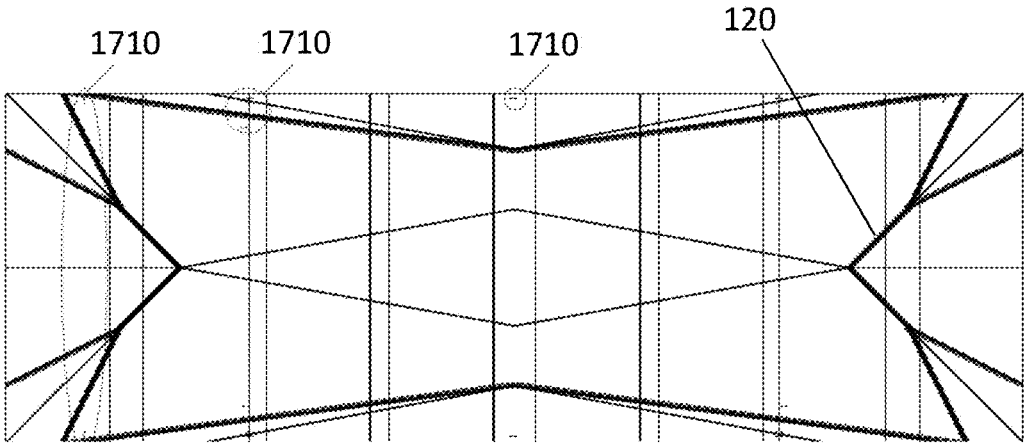
FIG. 22 shows the top view of a panel according to embodiments of the present invention.

FIG. 22 shows the top view of a panel 110 according to embodiments of the present invention. In this panel, folds 120 are present. In this figure, the crevices 1710 have been drawn too in which the tensioning straps 1510 may be stuck. From left to right, these are:

- crevices in which tensioning straps 1510 may be stuck to keep the nose together,
- crevices with which the edge 1540 that is slidable across may be attached and with which the sides of the watercraft may be tensioned towards one another,
- crevices with which the edge 1540 that is slidable across may be attached and with which the sides of the watercraft may be tensioned towards one another, and with which the spacer 1520 may be tensioned.

Figure 23:
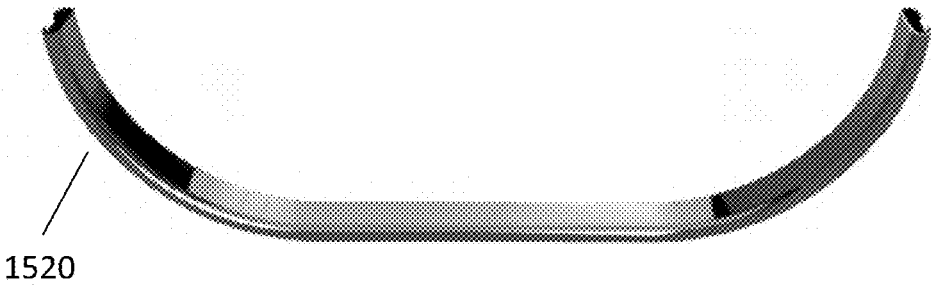
FIG. 23 shows a spacer according to embodiments of the present invention.

FIG. 23 shows a spacer 1520 according to embodiments of the present invention. This spacer 1520 may be clamped into the watercraft by means of tensioning straps 1510.

FIG. 24 shows another top view of an embodiment of a canoe according to an embodiment of the present invention.

It will be clear to the person skilled in the art that the watercraft described in relation to FIG. 6 to FIG. 24 is but an example of one embodiment of the present invention.

Another example of an embodiment of the present invention is indicated in relation to FIG. 25 to FIG. 29.

Figure 25:
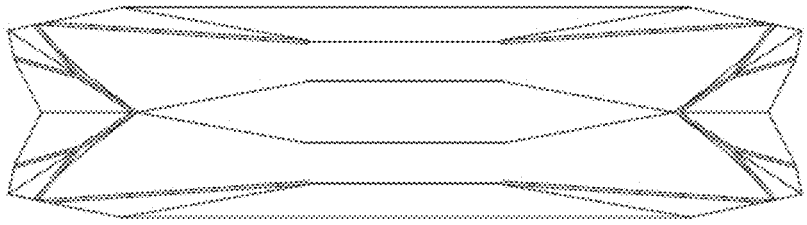
FIG. 25 to FIG. 29 illustrate an alternative example for an embodiment of the present invention.

FIG. 25 illustrates a top view of a folded-open panel in which the various pleat lines are clearly visible. Furthermore, it is clear that both single folds and double folds are visible. The specific configuration of the pleat lines diverges from the first example that was discussed above. It is an advantage of the specific folding pattern indicated in FIG. 25 that it results in an even better sturdiness and stability of the boat.

Figure 26:
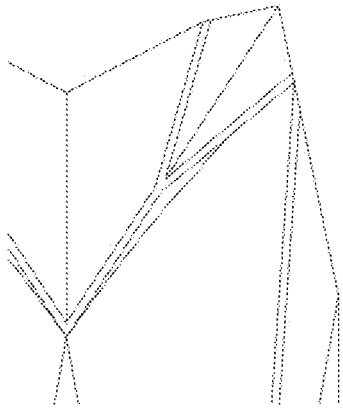

FIG. 26 illustrates a top view in more detail of a part of the boat.

Figure 27:
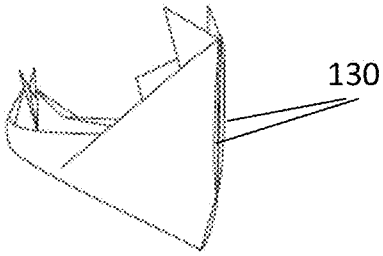

FIG. 27 illustrates a front view of the boat after it has been folded into boat shape.

Figure 28:
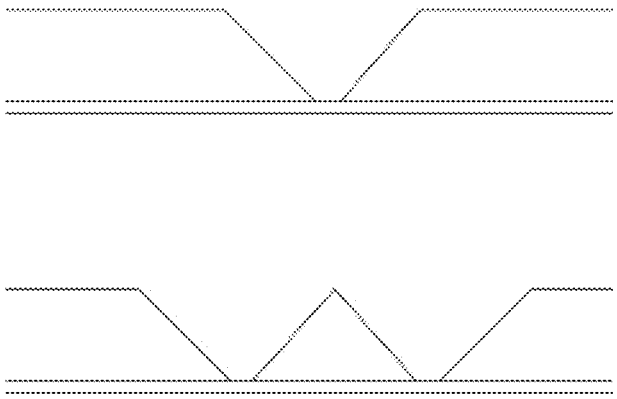

FIG. 28 illustrates the profile for a single fold and a double fold as it is used in an embodiment of the present invention when use is made of panels comprising two layers.

Figure 29:
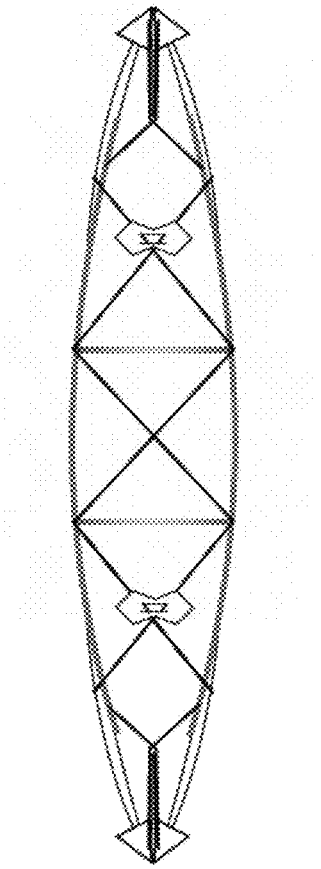

FIG. 29 illustrates a top view of the canoe according to FIG. 25. Various aspects of the canoe as discussed in the first example may also be applied to this canoe. In essence, the folding pattern in particular is different for the two examples that were given.

Figure 30:
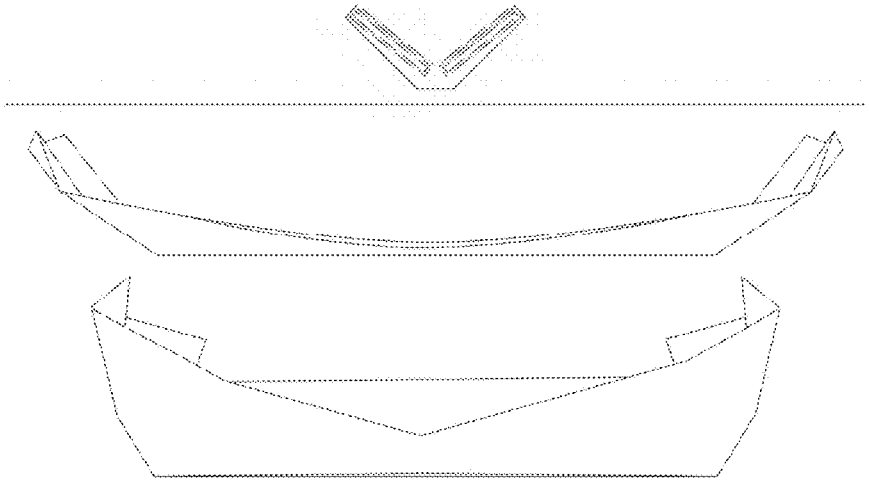
FIG. 30 illustrates how, by means of specific folding configurations, systems according to embodiments of the present invention may be pleated up into a specific shape.

FIG. 30 is a further illustration of an embodiment of the present invention whereby the folding pattern has been adapted such that the boat may be pleated via a double-spiral-shaped design. This has been indicated in FIG. 30.

The preceding examples each concerned a canoe as illustrations of the foldable watertight structures. However, it should be noted that the present invention is not restricted by this. As illustrations, examples of configurations for the folds for a number of other watercraft are indicated in FIGS. 31(A) to 31(C). From top to bottom are indicated subsequently the folding plans for a catamaran (A), a small sailing boat (B) and a classic motor boat (C). In FIG. 32, an example of a folded sailing boat is indicated.

The various aspects may easily be combined, and the combinations will also correspond with embodiments according to the present invention.

The invention claimed is:

1. A watertight foldable system, the system comprising a watertight panel in which folds have been made such that the panel may be folded from a flat state into an open-top watercraft, the panel comprising a set of folds such that the watercraft, after it has been folded into watercraft, has a bottom having a flat profile in longitudinal direction or having a convex profile relative to the watercraft, the set of folds comprising at least two subsets of folds, in which each of the subsets of folds consists of a first and a second fold which are substantially in the longitudinal direction of the boat, the first and the second folds not being in parallel but making contact with one another at an angle smaller than 90°, and which may be pleated such that the side wall of the watercraft, after it has been folded, is locally formed by three overlapping layers of the watertight panel.

2. A watertight foldable system according to claim 1, the first and the second folds starting from the edge of the panel, when it is in folded-open state and whereby the contact point of the two folds is more centrally located within the panel.

3. A watertight foldable system according to claim 1, in which the at least two subsets of folds are exactly four subsets of folds.

4. A watertight foldable system according to claim 1, the first fold being formed by two adjoining pleat lines.

5. A watertight foldable system according to claim 1, the watercraft being a canoe.

6. A watertight foldable system according to claim 1, at least one nose of the watercraft being formed by one or several folds such that the nose is locally formed by at least four overlapping layers of the watertight panel and/or at least one nose of the watercraft being formed by at least seven folds and/or at least one of the noses being formed from an extremity of the panel consisting of contiguous sections.

7. A watertight foldable system according to claim 6, the folding pattern having been adapted in order to provide, near the nose, a section of the panel that, when the system has been folded into watercraft, is substantially oriented in the latitudinal direction of the watercraft.

8. A watertight foldable system according to claim 1, the panel comprising several folds in the latitudinal direction such that the panel may be folded up into a transport shape for transporting the foldable watercraft, the length of the transport shape of which corresponding with the width of the folded-out panel.

9. A watertight foldable system according to claim 8, the pleat lines in the latitudinal direction having been made such that when the panel is folded up, hollow spaces are present inside the folded-up panel and/or the pleat lines in the latitudinal direction having been made such that the panel may be folded up in a single or double spiral shape.

10. A watertight foldable system according to claim 1, the system comprising tensioning straps which may be tensioned in a cross from one side of the watercraft to the other side of the watercraft and/or the system comprising a spacer which may be placed from one side to the other side of the watercraft.

11. A watertight foldable system according to claim 1, the system comprising at least two edges that are slidable across over the edges of the watercraft or the system comprising at least two edges that are slidable across over the edges of the watercraft, the edges consisting of a first profile with a U-shaped cross-section and a second profile that may be slid into the first profile and that furthermore is adapted to shield any sharp extremities of the first profile from the watercraft.

12. A watertight foldable system according to claim 11, an edge that is slidable across consisting of several shorter part elements that may be slid into one another.

13. A watertight foldable system according to claim 1, the system comprising at least one rafter which may be positioned across the watercraft, meeting the inside of it and/or the system comprising a shielding that closely meets the folded-up panel for shielding the folded-up panel, folded up in its transport shape.

14. A watertight foldable system according to claim 13, castors having been mounted onto the shielding, for transporting the folded-up panel by rolling it, folded up into its transport shape.

15. A watertight foldable system according to claim 1, the watertight panel consisting of a minimum of two layers, a first flexible watertight layer and a second non-flexible layer, the first and the second layers permanently being attached together such that they form one whole, the panel comprising folds, the folds having been made into the second layer such that the panel may be folded into a pre-intended shape.

16. A watertight, foldable system according to claim 15, the fold consisting of at least one cut in the second layer, while no cut or pleat line has been made into the first flexible watertight layer or the fold consisting of a pleat line in the second layer, while no cut or pleat line has been made into the first flexible watertight layer, and the cross-section of the pleat line in the second layer being a corner.

17. A watertight, foldable system according to claim 15, the fold consisting of two adjoining pleat lines and the distance between the two pleat lines being smaller than the width of a pleat line.

18. A watertight, foldable system according to claim 1, the second layer of material comprising a honeycomb structure.

19. A watertight, foldable system according to claim 1, the system comprising a cover which may be tensioned across the hull of the folded boat or the system comprising a cover which may be tensioned across the hull of the folded boat and the material having been fitted in various places in a rubber-derived substance that may serve as a bumper for the boat when the rubber-derived substance has been tensioned around the hull of the boat.

* * * * *